US006589315B1

(12) United States Patent
Pötzl

(10) Patent No.: US 6,589,315 B1
(45) Date of Patent: Jul. 8, 2003

(54) METHOD FOR THERMALLY REGENERATING THE HEAT EXCHANGER MATERIAL OF A REGENERATIVE POST-COMBUSTION DEVICE

(75) Inventor: Walter Pötzl, Ammerbuch (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/018,295

(22) PCT Filed: May 31, 2000

(86) PCT No.: PCT/EP00/04955

§ 371 (c)(1),
(2), (4) Date: Dec. 10, 2001

(87) PCT Pub. No.: WO00/77451

PCT Pub. Date: Dec. 21, 2000

(30) Foreign Application Priority Data

Jun. 10, 1999 (DE) ..... 199 26 428

(51) Int. Cl.[7] ..... F23D 14/00

(52) U.S. Cl. ..... 95/148; 110/211; 431/5; 432/181

(58) Field of Search ..... 95/90, 148, 276; 96/124; 110/211; 431/5; 422/175, 180; 432/2, 180, 181

(56) References Cited

U.S. PATENT DOCUMENTS

| | | | | |
|---|---|---|---|---|
| 3,870,474 A | * | 3/1975 | Houston | 110/243 |
| 4,126,419 A | * | 11/1978 | Katabuchi et al. | 110/210 |
| 5,016,547 A | * | 5/1991 | Thomason | 110/210 |
| 5,259,757 A | | 11/1993 | Plejdrup et al. | 432/181 |
| 5,346,393 A | | 9/1994 | D'Souza | 432/179 |
| 5,460,789 A | * | 10/1995 | Wilhelm | 110/204 |
| 5,538,420 A | | 7/1996 | Klobucar et al. | 432/2 |
| 5,562,442 A | * | 10/1996 | Wilhelm | 110/211 |
| 5,620,668 A | | 4/1997 | Driscoll et al. | 422/175 |
| 5,643,539 A | | 7/1997 | Collard et al. | 422/178 |
| 5,839,894 A | | 11/1998 | Schedler et al. | 432/181 |
| 5,871,349 A | * | 2/1999 | Johnson et al. | 165/7 |
| 6,203,316 B1 | * | 3/2001 | Pennington | 165/5 |

FOREIGN PATENT DOCUMENTS

| | | |
|---|---|---|
| EP | 0 179 984 A2 | 7/1985 |
| EP | 0 5480 630 A1 | 12/1992 |

* cited by examiner

*Primary Examiner*—David A. Simmons
*Assistant Examiner*—Frank M. Lawrence
(74) *Attorney, Agent, or Firm*—Factor & Partners

(57) ABSTRACT

In order to regenerate the heat exchanger material located in the various segments of a housing section (2) of a regenerative post-combustion device (1), fresh air is fed via the flushing air connection (11) into the combustion chamber (8) of this post-combustion device (1), is heated there by a burner (9), and is fed to the rotary distributor (5) via a segment of the heat exchanger material. Heated air which, when passing through the heat exchanger material has picked up contaminants deposited thereon is fed to the inlet or outlet connection (4, 10) of the post-combustion device (1) via the rotary distributor (5) and, from there, is introduced once again into the combustion chamber (8). The rotary distributor (5) of the thermal post-combustion device (1) stops during this process which is continued until the heat exchanger material is heated to a temperature at which the contaminants absorbed by the heat exchanger material are released and combusted in the combustion chamber (8). This regeneration is carried out, in turn, for all segments by a corresponding clocked advance of the rotary distributor (5).

4 Claims, 2 Drawing Sheets

METHOD FOR THERMALLY REGENERATING THE HEAT EXCHANGER MATERIAL OF A REGENERATIVE POST-COMBUSTION DEVICE

SUMMARY OF THE INVENTION

The invention concerns a method for thermally regenerating the heat exchanger material of a regenerative post-combustion device, which in a housing includes from top to bottom:

a) a combustion chamber;

b) a section, which is divided into several segments filled with heat exchanger material, c) a rotary distributor, which according to its rotary position produces:

ca) a connection between an inlet connection for exhaust gas to be purified with a first segment of the heat exchanger material;

cb) a connection between a second segment of the heat exchanger material and an outlet connection for purified gas;

cc) a connection between a third segment of the heat exchanger material, leading the second segment in the rotational direction of the rotary distributor, and a connection for flushing gas, in which method fresh air is heated in the combustion chamber and is fed one after another through all the segments of the heat exchanger material, as a result of which the heat exchanger material is brought to a temperature, at which the contaminants absorbed in the heat exchanger material are released.

Regenerative post-combustion devices serve to purify contaminated exhaust gases from industrial processes. To conserve energy during the thermal post-combustion the exhaust gases to be purified are fed through heat exchanger material. Since the exhaust gases to be purified frequently contain organic contaminants in the form of condensable substances, for example tar products or organic dusts, the surfaces of these heat exchanger materials clog up during the course of operation with these contaminants. To regenerate the heat exchanger materials these must be periodically heated to a temperature at which the contaminants absorbed on the surface are released and can be carried away. This happens with the known thermal post-combustion devices due to the fact that fresh air is introduced into the combustion chamber, heated there to high temperature and then fed from the top through the heat exchanger material to the bottom, taken via the rotary distributor to the outlet and then evacuated to the outside atmosphere via the flue. The rotary distributor stops during this process. There is a wait until the segment of the heat exchanger material flushed through in each case from top to bottom has heated up to the necessary temperature, so that any contaminants are released from all areas of the heat exchanger material in this segment. Afterwards the rotary distributor is advanced by one segment and the process begins again from the start.

The disadvantage with this known method to regenerate the heat exchanger material is on the one hand the relatively long time which is required to clean all the segments. Furthermore the gas ducted to the flue contains contaminants, which have been released from the heat exchanger material, and therefore is not clean.

Aim of the present invention is to create a method of the type mentioned at the beginning in such a way that no contaminants are emitted into the surrounding atmosphere.

This aim is achieved according to the invention by the fact that the air heated in the combustion chamber for thermal regeneration is fed from the combustion chamber via a segment of the heat exchanger material downwards and via the rotary distributor to the inlet or outlet connection and from there is once again fed directly into the combustion chamber and that the air is ducted in the circuit with the rotary distributor stopped until the heat exchanger material in the segment is sufficiently hot and all contaminants are released from this, whereupon this process is carried out in turn for all the other segments.

Because in the case of the method according to the invention the hot air escaping from the heat exchanger material is not fed directly to the flue but is fed again into the combustion chamber of the post-combustion device for further post-combustion, the hot gases used for regeneration also leave the post-combustion device completely clean; contaminants are not emitted into the outer atmosphere via the waste gas flue.

Many known post-combustion devices are designed so that either the inlet or the outlet is not connected directly via a pipe with the rotary distributor. Rather the inlet or the outlet first leads into a plenum chamber in the lower section of the housing of the post-combustion device which then in its turn communicates with one of the different channels of the rotary distributor. The other particular connection communicates via a pipe with the rotary distributor. Should with the method according to the invention post-combustion devices of this design be thermally regenerated, it is recommended that the air used for regeneration is fed via that connection which does not communicate with the plenum chamber. This has the advantage that the number of components of the post-combustion device which come into contact with the hot air and therefore must resist high temperature, can be kept relatively small. Additionally in this way the connecting pipe between the connection and the rotary distributor can be cleaned, which is especially important if the connection in question concerns the inlet connection.

The oxygen needed for oxidation is supplied by fresh air.

BRIEF DESCRIPTION OF THE DRAWINGS

Embodiments of the invention are explained by way of the drawings in more detail below; these show.

DETAILED DESCRIPTION OF THE PREFERRED EMBODIMENTS

Figure 1:
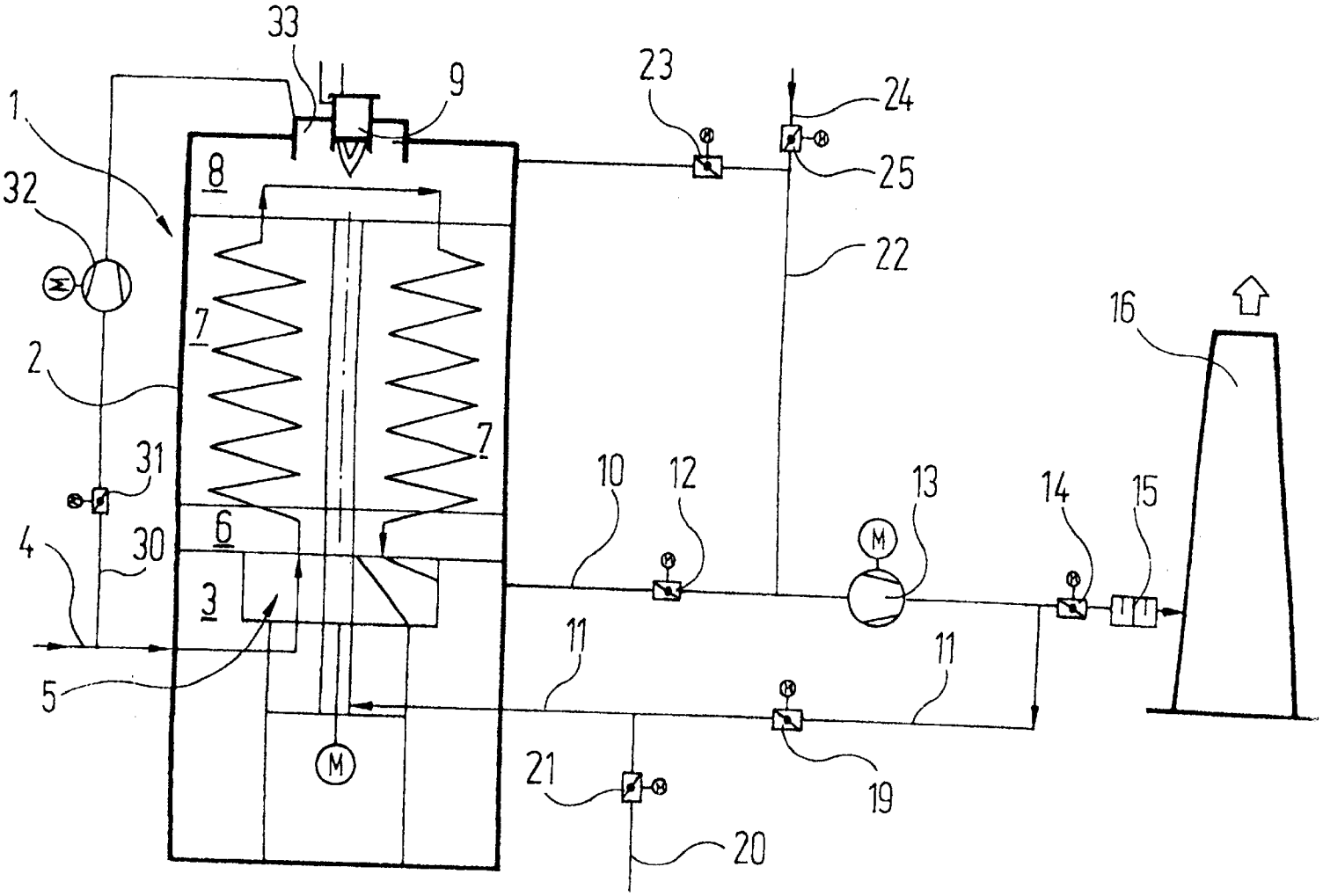
FIG. 1 in a diagram a regenerative post-combustion device with the most important peripheral devices required for its operation.

In FIG. 1 a regenerative post-combustion device is identified with the reference symbol 1. Its basic structure and its basic method of operation are described—provided not stated otherwise below—in EP 0 548 630 A1 or EP 0 719 984 A2 to which reference is expressly made.

In the lower section of the housing 2 of the regenerative post-combustion device 1 an inlet pipe 4 for the exhaust gas to be purified is introduced. It communicates with a rotary distributor 5 housed in the lower section of the housing 2 which depending on its rotary position produces a connection between the inlet pipe 4 and a segment produced from a number of cake-slice shaped segments in a distribution chamber 6 arranged above the rotary distributor 5. Again above the distribution chamber 6 there is in the housing 2 a heat exchange chamber 7 which is divided into a corresponding number of segments which in each case communicate with a corresponding segment of the distribution chamber 6 below these. The segments of the heat exchange chamber 7 are filled with the exchanger material.

Above the heat exchange chamber 7 there is in the uppermost section of the housing 2 a combustion chamber 8, to which a burner 9 is joined.

The rotary distributor 5 in a known way is designed so that it joins a further segment of the distribution chamber 6, which generally faces the first mentioned segment diametrically and therefore also a further segment of the heat exchanger chamber 7 with an outlet plenum chamber 3 in the lower section of the housing 2, which is joined by an outlet pipe 10 for purified gas. Finally the rotary distributor 5 produces a connection between that segment of the distribution chamber 5 and therefore of the heat exchange chamber 7 with a flushing air pipe 11, which leads that segment seen I the rotational direction of the rotary distributors 5, which communicates with the outlet-plenum chamber 3.

The outlet pipe 10 for purified gas leads via a motor-driven valve 12 as well as a fan 13, a further motor-driven valve 14 and an acoustic damper 15 to a flue 16. A flushing air pipe 11 in which a further motor-driven valve 19 lies branches off between the fan 13 and the motor-driven valve 14. A fresh air pipe 20 which can be connected by a further motor-driven valve 21 also joins the regenerative post-combustion device 1 between the valve 19 and the inlet.

The combustion chamber 8 is connected with the outlet pipe 10 for purified gases at a point between the motor-driven valve 12 and the fan 13; this connection can be opened or closed with a motor-driven valve 23. Between the motor-driven valve 23 and the joining point to the outlet pipe 10 a fresh air supply pipe 24 which can also be closed off by a motor-driven valve 25 joins the pipe 22.

Finally the inlet pipe 4 is connected via a pipe 30 in which a motor-driven valve 31 and a fan 32 lie, with a gap 33 in the upper section of the housing 2 which surrounds the burner 9.

Normal operation of the regenerative post-combustion device 1, in which contaminated exhaust gases are treated, corresponds to the known operation:

The exhaust gas to be purified is fed via the exhaust gas pipe 4 into the regenerative post-combustion device 1 and ducted to the rotary distributor 5. According to the particular rotary position of the rotary distributor 5 it is further ducted into a certain segment of the distribution chamber 6. The exhaust gas rises from this segment of the distribution chamber 6 to the segment above this of the heat exchange chamber 7 and absorbs there previously stored heat from the heat exchanger material. The exhaust gas is heated up when passing through the heat exchanger material until it has either reached the ignition temperature for the contaminants contained in it or approaches this ignition temperature when escaping from the upper side from the heat exchanger chamber 7. In the latter case the contaminants are combusted with the aid of the burner 9; in the first case combustion takes place without any extra energy being supplied.

The heated air now containing the (non-hazardous) combustion products escapes from above into a segment of the heat exchange chamber 7 and passes down through this. At the same time it dissipates a major portion of its heat in the heat exchanger material there and, on the underside of the heat exchange chamber 7, cooled accordingly it enters the corresponding segment of the distribution chamber 6 and is fed by the rotary distributor 5 of the outlet-plenum chamber 3 into the lower section of the housing 2 and carried out via the outlet pipe 10. In this mode of operation the motor-driven valves 12, 14 are open and the motor-driven valves 23, 25 and 31 are closed. The clean air is carried out into the outer atmosphere via the flue 16 with the aid of the fan 13.

As already mentioned above the same segment of the heat exchange chamber 7 which leads the segment through which pure air has passed in the rotary direction of the rotary distributor 5 is purged with flushing air. This purging process takes place in the embodiment illustrated somewhat differently than with the patents mentioned above: namely in this case clean air is supplied via the rotary distributor 5 to the corresponding segment of the heat exchanger 7 via the flushing air pipe 11 when the motor-driven valve 19 is open and the motor-driven valve 21 is closed. This difference in the method of purging is however not important for the basic method of operation of the thermal post-combustion device 1 in any case in the present context.

After longer operating periods the heat exchange material in the heat exchanger chamber 7 requires regeneration since its surfaces become clogged with substances, for example tar products or organic dust which is brought along by the exhaust gas to be purified. This thermal regeneration process takes place in the case of the regenerative post-combustion device 1 described as follows:

The supply of exhaust gas to be purified is shut off via the inlet pipe 4. The motor-driven valves 12 and 19 are closed; on the contrary the motor-driven valves 14, 21, 23 and 25 are open.

In this controlled state of the various motor-driven valves fresh air is introduced to the regenerative post-combustion device 1 via the fresh air supply pipe 20 and the flushing air pipe 11 and fed via the corresponding segment of the heat exchange chamber 7 into the combustion chamber 8. There this air is heated with the aid of the burner 9. The heated air now passes into that segment of the heat exchange chamber 7 which communicates via the rotary distributor 5 with the inlet pipe 4. If the motor-driven valve 31 in the pipe 30 is open, this hot air is sucked through the corresponding segment of the heat exchanger chamber 7, the distribution chamber 6 and the rotary distributor 5 with the aid of the fan 32 and again fed into the combustion chamber 8 via the gap 33 near the burner 9. Contaminants which the flushing air has absorbed on its way through the heat exchanger material are combusted in the combustion chamber 8.

The hot air is circulated in the way described while the rotary distributor 5 is stopped. Excess air in the circuit is taken away to the flue 16 by opening the motor-driven valve 14 accordingly. The temperature of the hot gases dissipated in this way can be reduced by adding fresh air via the pipe 24 in the required way by opening the motor-driven valve 25 accordingly.

The air circulation described continues until the heat exchanger material has also reached that temperature in the lowest sections at which the deposits are released from the heat exchanger material. When this process has finished the rotary distributor 5 is advanced by one segment. When all segments are clean, the various motor-driven valves are again set to the initial position and the supply of exhaust gas to be purified is again started via the inlet pipe 4.

Figure 2:
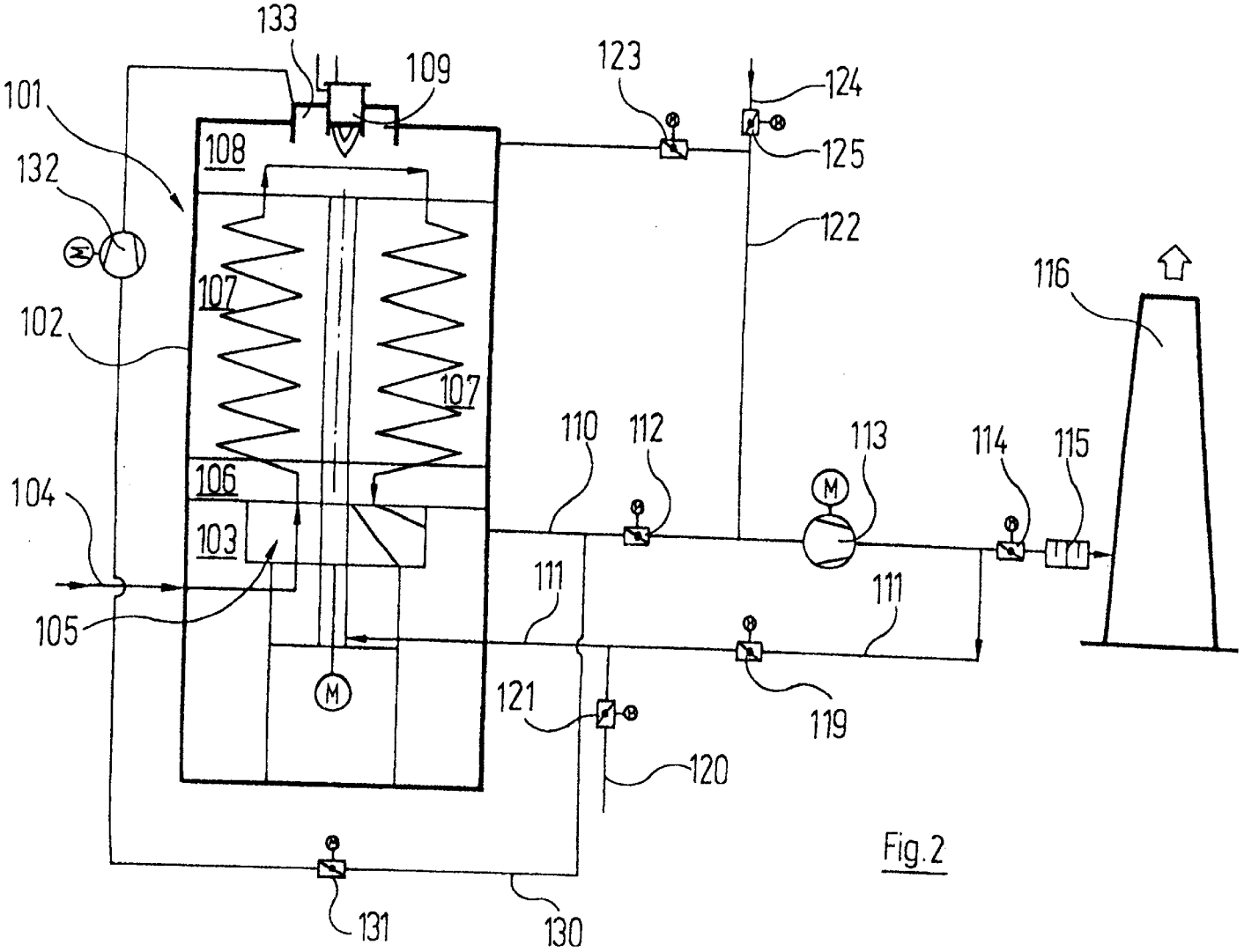
FIG. 2 the same regenerative post-combustion device however with somewhat different peripheral devices.

A slightly different variant of the above described regeneration method is illustrated in FIG. 2. This contains for the most part the same components as the embodiment in FIG. 1; corresponding components are identified with the same reference symbol plus 100 and are not described again in the following.

The essential difference from the initial example in FIG. 2 compared to that in FIG. 1 is as follows:

While in FIG. 1 the inlet pipe 4 was connected via the pipe 30 with the gap 33 near the burner 9 of the regenerative post-combustion device 1, in the case of the embodiment in FIG. 2 the pipe 130, in which the fan 132 lies, leads from the gap 133 near the burner 109 to the outlet pipe 110 for purified gas. This has the following functional difference during the regeneration of the heat exchanger material:

While in the case of the embodiment described above by way of FIG. 1 the heated combustion gases escaped from the combustion chamber 8 into that segment of the heat exchange chamber 7 which is connected via the rotary distributor 5 with the inlet pipe 4, in the case of the embodiment in FIG. 2 the heated gases enter the same segment of the heat exchange chamber 107 which communicates via the rotary distributor 105 with the outlet-plenum chamber 103. The circulation path of the heated regeneration gases therefore does not lead via the inlet pipe 104 but via the outlet-plenum chamber 103 and the outlet pipe 110. However this difference results in the fact that hot regeneration air no longer passes through the inlet pipe 104 for exhaust gases to be purified and is therefore no longer freed from contaminants. Also in the case of the embodiment in FIG. 2 the total lower section of the regenerative post-combustion device 101 is heated up since the hot regeneration gases escaping from the rotary distributor 105 fill the total outlet-plenum chamber 103. Normally therefore preference is given to the embodiment in FIG. 1.

What is claimed is:

1. A method for thermally regenerating the heat exchanger material of a regenerative post-combustion device, which in a housing includes from top to bottom:

a) a combustion chamber;

b) a section which is divided into several segments filled with heat exchanger material;

c) a rotary distributor, which according to its rotary position produces:

ca) a connection between an inlet connection for exhaust gas to be purified with a first segment of the heat exchanger material;

cb) a connection between a second segment of the heat exchanger material and an outlet connection for purified gas;

cc) a connection between a third segment of the heat exchanger material, leading the second segment in rotational direction of the rotary distributor, and a connection for flushing gas;

in which method fresh air is heated in the combustion chamber and is fed one after another through all the segments of the heat exchanger material, as a result of which the heat exchanger material is brought to a temperature, at which the contaminants absorbed by the heat exchanger material are released, the air used for the thermal regeneration and heated in the combustion chamber is fed from the combustion chamber via a segment of the heat exchanger material to the bottom and via the rotary distributor to the inlet connection or outlet and is again fed from there into the combustion chamber;

the air is kept in the circuit with the rotary distributor stopped until the heat exchanger material in the segment is sufficiently hot and all contaminants are released from this, whereupon this process is carried out in turn for all the other segments;

fresh air is added into the circuit in order to increase the oxygen content of the air in the circuit; and excess air is continuously taken away from the circuit and is mixed with fresh air in order to reduce its temperature and is at least partly led to a flue.

2. The method according to claim 1 for use with a regenerative post-combustion device in which the inlet or the outlet connection joins a plenum chamber formed in the lower section of the housing, which in its turn communicates with the rotary distributor, while the other individual connection communicates via a pipe directly with the rotary distributor, characterized in that the air used for regeneration is fed via that connection which does not communicate with the plenum chamber.

3. The method according to claim 1, characterized in that the fresh air used for the thermal regeneration is fed via the connection for flushing gas.

4. The method according to claim 2, characterized in that the fresh air used for the thermal regeneration is fed via the connection for flushing gas.

* * * * *